US006425811B1

(12) United States Patent
Marks, Jr.

(10) Patent No.: US 6,425,811 B1
(45) Date of Patent: Jul. 30, 2002

(54) SANDER FOR SMOOTHING CURVILINEAR SURFACES

(76) Inventor: George E. Marks, Jr., 215 Holly Hill Dr., Reidsville, NC (US) 27320

( * ) Notice: Subject to any disclaimer, the term of this patent is extended or adjusted under 35 U.S.C. 154(b) by 0 days.

(21) Appl. No.: 09/594,534

(22) Filed: Jun. 14, 2000

Related U.S. Application Data

(63) Continuation-in-part of application No. 09/184,932, filed on Oct. 2, 1998, now abandoned.

(51) Int. Cl.[7] ..... B24B 21/00
(52) U.S. Cl. ..... 451/303; 451/296
(58) Field of Search ..... 451/303, 355, 451/296, 311

(56) References Cited

U.S. PATENT DOCUMENTS

| | | | | | |
|---|---|---|---|---|---|
| 2,060,266 | A | * | 11/1936 | Thompson | 451/303 |
| 2,199,069 | A | * | 4/1940 | Fowler | 451/355 |
| 3,334,447 | A | * | 8/1967 | Leveque | 451/355 |
| 4,137,673 | A | * | 2/1979 | La Tour | 451/303 |
| 4,510,718 | A | * | 4/1985 | Eichenlaub | 451/303 |
| 4,694,616 | A | * | 9/1987 | Lindberg | 451/355 |

FOREIGN PATENT DOCUMENTS

| | | | | |
|---|---|---|---|---|
| DE | 448023 | * | 8/1927 | 451/296 |

* cited by examiner

*Primary Examiner*—Robert A. Rose
(74) *Attorney, Agent, or Firm*—Kenneth L Tolar

(57) ABSTRACT

A sander for smoothing curvilinear surfaces includes a horizontal support surface having top and bottom sides. The support surface has two sets of inner and outer arcuate slots thereon. The inner arcuate slots each have idler rollers thereabove secured to a pivoting, spring biased circular plate therebelow. A continuous sanding belt encompasses the idler rollers and a drive roller and is moved along a substantially triangular path with a motor means. A section of the path defines a sanding portion immediately adjacent to which is a flexible plate. An adjustment mechanism is provided to bend the plate to a desired configuration to form a curved sanding portion. The plate has an anchoring post on each side that is received within an outer arcuate slot and is secured to the circular plate therebelow. The plates, idler rollers and anchoring posts maintain tension on the belt regardless of the orientation of the sanding surface. A hand held sander is also provided in which an arcuate sanding portion may be formed in a manner similar to that described above.

8 Claims, 7 Drawing Sheets

SANDER FOR SMOOTHING CURVILINEAR SURFACES

This is a continuation-in-part of application Ser. No. 09/184,932, filed on Oct. 2, 1998 now abandoned.

BACKGROUND OF THE INVENTION

The present invention relates to a motor driven sander specifically designed to smooth curved surfaces.

DESCRIPTION OF THE PRIOR ART

Conventional power sanders typically include a motor driven sanding belt wrapped about a plurality of rollers to form a continuous loop. The portion of the loop that contacts the surface to be sanded is usually flat and is generally not suitable for smoothing curved surfaces such as those found on various furniture items, automobile parts and similar products. W Accordingly, there is currently a need for a device having a motor driven sanding belt which may be selectively bent to sand a curved surface.

Various sanding devices some of which purport to grind or smooth curved surfaces have been heretofore designed. For example, U.S. Pat. No. 5,545,077 issued to Boeck et al relates to a motor driven belt grinder with a plate tensioning means. An insert plate may be inserted into a slot to vary the distance between the motor housing and an attached case to selectively vary the tension of the belt.

U.S. Pat. No. 5,319,887 issued to Walz et al relates to a hand sander including a housing with a drive roller and a deflecting roller both rotatably supported therein; an endless sanding belt is guided along the deflecting roller and an attached guide plate.

U.S. Pat. No. 4,587,770 issued to Lindberg relates to a belt sander attachable to a portable drill for sanding curved or flat surfaces. The device includes a frame having a drive roller and an idle roller with a movable carriage carrying a second idle roller. A combined guard plate and pressure guide enables guidance and application of sanding pressure by the user.

U.S. Pat. No. 4,334,390 issued to Sumerau relates to a motor driven belt sander having a low profile and a center of gravity close to the sanding plane. A belt is placed about three triangularly disposed drums with the motor disposed within the belt path. The motor and a support mechanism is mounted to a one piece frame which hangs from the housing.

U.S. Pat. No. 3,611,646 issued to Cameron et al relates to an apparatus for supporting the pulley of a belt grinder in which the attachment angle may be varied.

U.S. Pat. No. 3,417,511 issued to Dudek relates to a belt sander having means for directing cooling air from the motor to the belt as well as a special bearing arrangement that minimizes resistance due to binding between the parts of a tensioning means.

Although at least one sander exists in the prior art that is designed to smooth curved surfaces, none relate to a simple, versatile device employing a sanding belt which may be selectively conformed to a variety of surfaces. The present invention provides a motor driven sanding belt driven along a continuous path, a section of which defines a sanding portion. The curvature of the sanding portion may be selectively varied to conform to various curvilinear surfaces.

SUMMARY OF THE INVENTION

The present invention relates to a unique motor driven sander for smoothing curvilinear surfaces such as those found on furniture items and automobile parts. A first embodiment is preferably mounted to a table top or a similar horizontal support surface. A pair of spring biased circular plates are pivotally secured to the lower side of the horizontal support surface each immediately below an inner and outer arcuate slot on the support surface. A pair of idler rollers and a drive roller are disposed on the top side of the support surface in a substantially triangular configuration. Each idler roller is immediately above an inner slot and is secured to the pivoting plate therebelow allowing the roller to reciprocate within the slot. A continuous sanding belt is wrapped around the idler and drive rollers which drive the belt along a substantially triangular path. The section of the path between the two idler rollers forms a sanding portion. Within the boundary of the belt immediately adjacent the sanding portion is a flexible, vertical plate having an anchor post at each of two opposing sides thereof. Each anchor post is disposed within an outer arcuate slot and is likewise secured to one of the pivoting circular plates therebelow. Proximal the inwardly facing side of the flexible plate is a movable engagement member having an arcuate outer edge immediately adjacent the plate. When the arcuate edge is thrust against an intermediate portion of the flexible plate, the plate bends and simultaneously engages the belt causing the sanding portion to assume a curved orientation. The curvature of the sanding portion may be selectively varied by moving the plate a desired distance. A fixed block is immediately adjacent the engagement member having a bolt therethrough an end of which impinges the inner edge of the engagement member to move it back and forth. The drive roller is rotated with a motor means disposed on the lower side of the horizontal support surface.

A second embodiment relates to a hand held sander including a handle member having a flat blade extending therefrom. On a first side of the blade are a plurality of idler rollers and a drive roller with a continuous sanding belt wrapped thereabout. A semicircular engagement member similar to that of the first embodiment is attached to the blade immediately adjacent the belt, preferably the lower portion thereof. On an opposing side of the blade is an adjustment knob for displacing a plate resting on the upper surface of the engagement member to move the lower semi-circular edge up and down to vary the curvature of the sanding portion. It is therefore an object of the present invention to provide a sander which can effectively smooth curvilinear surfaces.

It is yet another object of the present invention to provide a sander having an arcuate sanding portion, the curvature of which may be selectively varied.

It is yet another object of the present invention to provide a sander which may effectively smooth various curvilinear surfaces using a hand held, easily transportable device. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
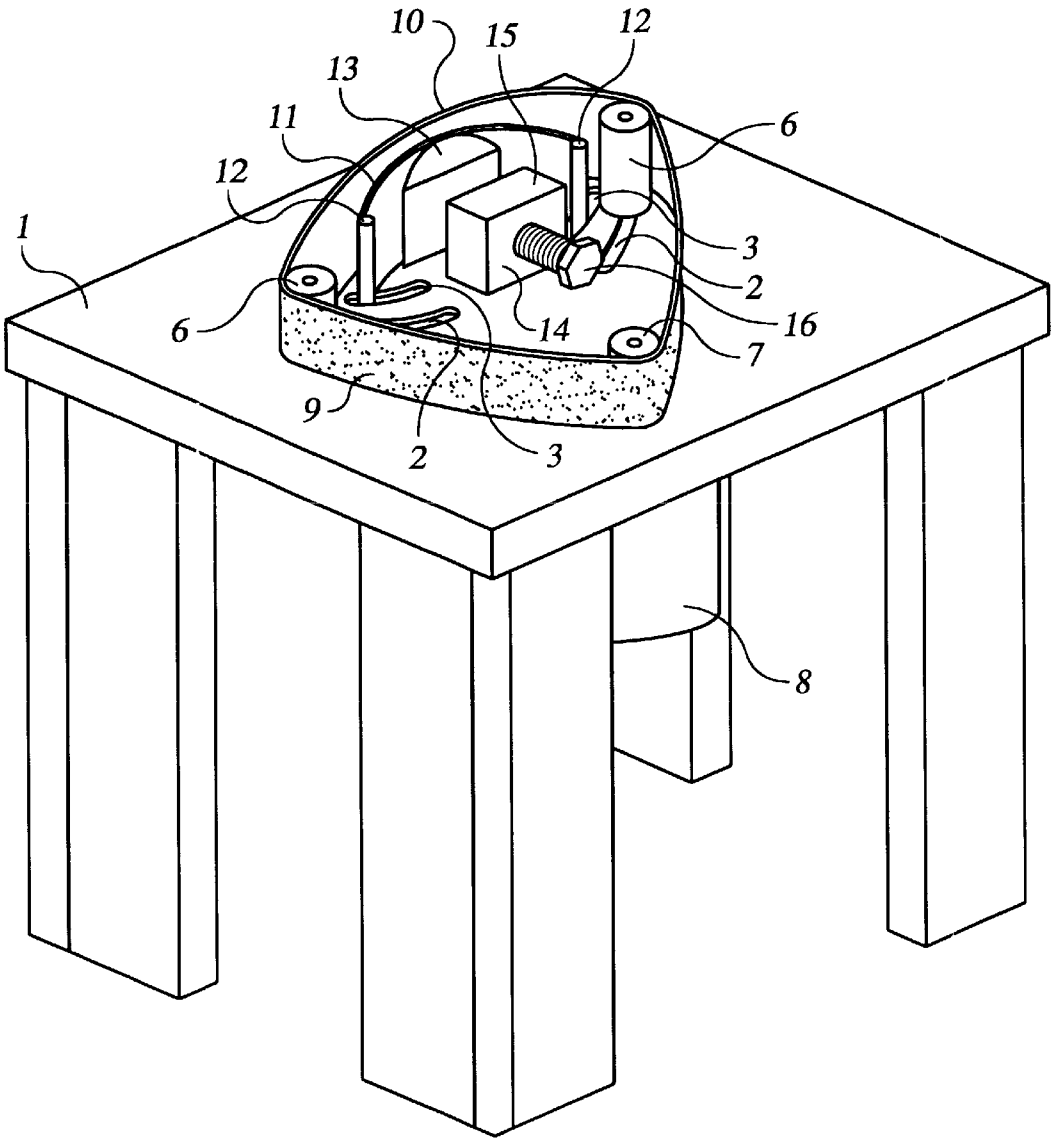
FIG. 1 depicts a first embodiment according to the present invention.
Figure 2:
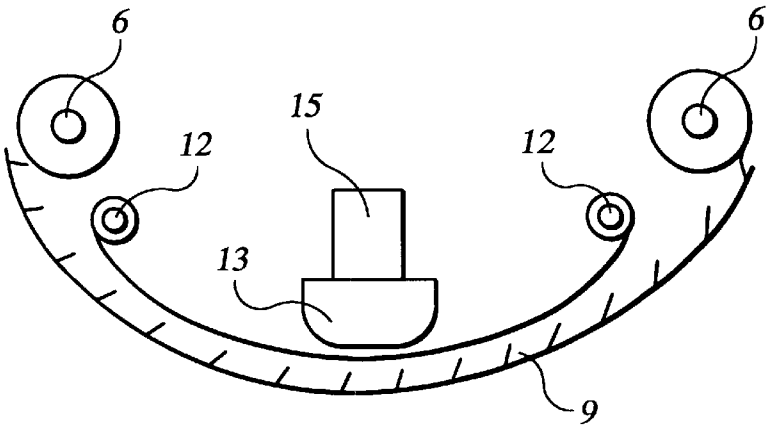
FIG. 2 depicts a top view of the first embodiment.
Figure 3:
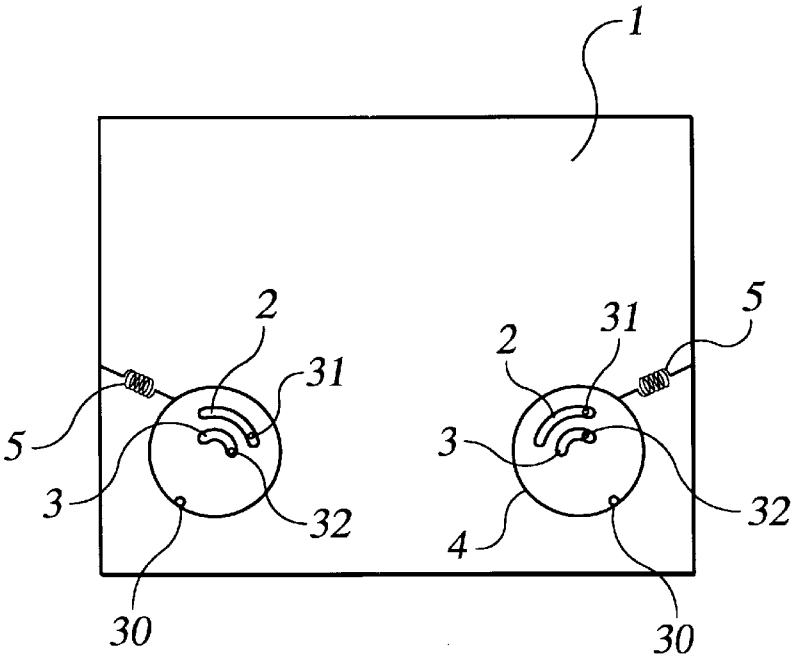
FIG. 3 depicts the lower side of the support surface.

Referring now to FIGS. 1 through 3, the present invention relates to a sander capable of smoothing curvilinear surfaces such as those found on automobile parts and furniture. The device includes a horizontal support surface 1 such as a table top or similar structure having a top and a bottom side with two inner 2 and outer 3 slots extending from the top side to the bottom side. Attached to the bottom side of the support surface immediately below each pair of slots is a circular pivot plate 4. The pivot plate 4 is secured to the support surface with a single fastener means 30 positioned immediately adjacent its peripheral edge. Two select points on the plate pivot about the fastener means in vertical alignment with the arcuate slots for reasons described in more detail below. An elongated coil spring 5 extends from the outer edge of each plate to an outer portion of the support surface to bias the plate outwardly about its pivot point.

Extending from the top side of the support surface are a pair of idler rollers 6, each having a fastener means 31 on its bottom end. The fastener means 31 is received within an inner slot and is secured to the circular plate therebelow allowing the rollers to synchronously pivot. A third drive roller 7 is received within an aperture on the support surface and is operable with a motor means 8 disposed on the bottom side of the support surface. The idler rollers and the drive roller are arranged in a substantially triangular orientation.

Wrapped about the idler and drive rollers is a continuous sanding belt 9 that is driven along a substantially triangular path. The section of the belt between the two idler rollers forms a sanding portion 10. Within the boundary of the sanding belt immediately adjacent the sanding portion is a flexible, bendable plate 11 having an anchoring post 12 at each of two vertical opposing side edges thereof Each anchoring post is received within an outer arcuate slot and is secured to the circular pivot plate therebelow with a fastener means 32.

Immediately adjacent an intermediate portion of the flexible plate is a movable engagement member 13 having semicircular outer edge and a planar inner edge with its semicircular edge immediately adjacent the plate. The engagement member may be moved a desired distance towards the flexible plate with an adjustment means 14. The adjustment means includes a fixed block 15 having a bolt 16 therethrough an end of which abuts the planar edge of the engagement member. The bolt is rotated in either direction to move the engagement member to a desired position.

Accordingly, as the engagement member is urged against the plate, the plate bends and simultaneously engages the belt to form a sanding portion having an arcuate configuration. The curvature of the sanding portion may be selectively varied to conform to a variety of surfaces by simply further moving the engagement member. Likewise, the pivoting plates and attached idler rollers and anchoring posts are forced inwardly against the bias of springs 5 to provide a belt tensioning means. Therefore, the belt remains taut regardless of the configuration of the sanding portion. When the engagement member is completely retracted from the plate, the sanding portion assumes substantially linear configuration while the plates, rollers and anchoring posts pivot outwardly to maintain tension on the belt.

Figure 4:
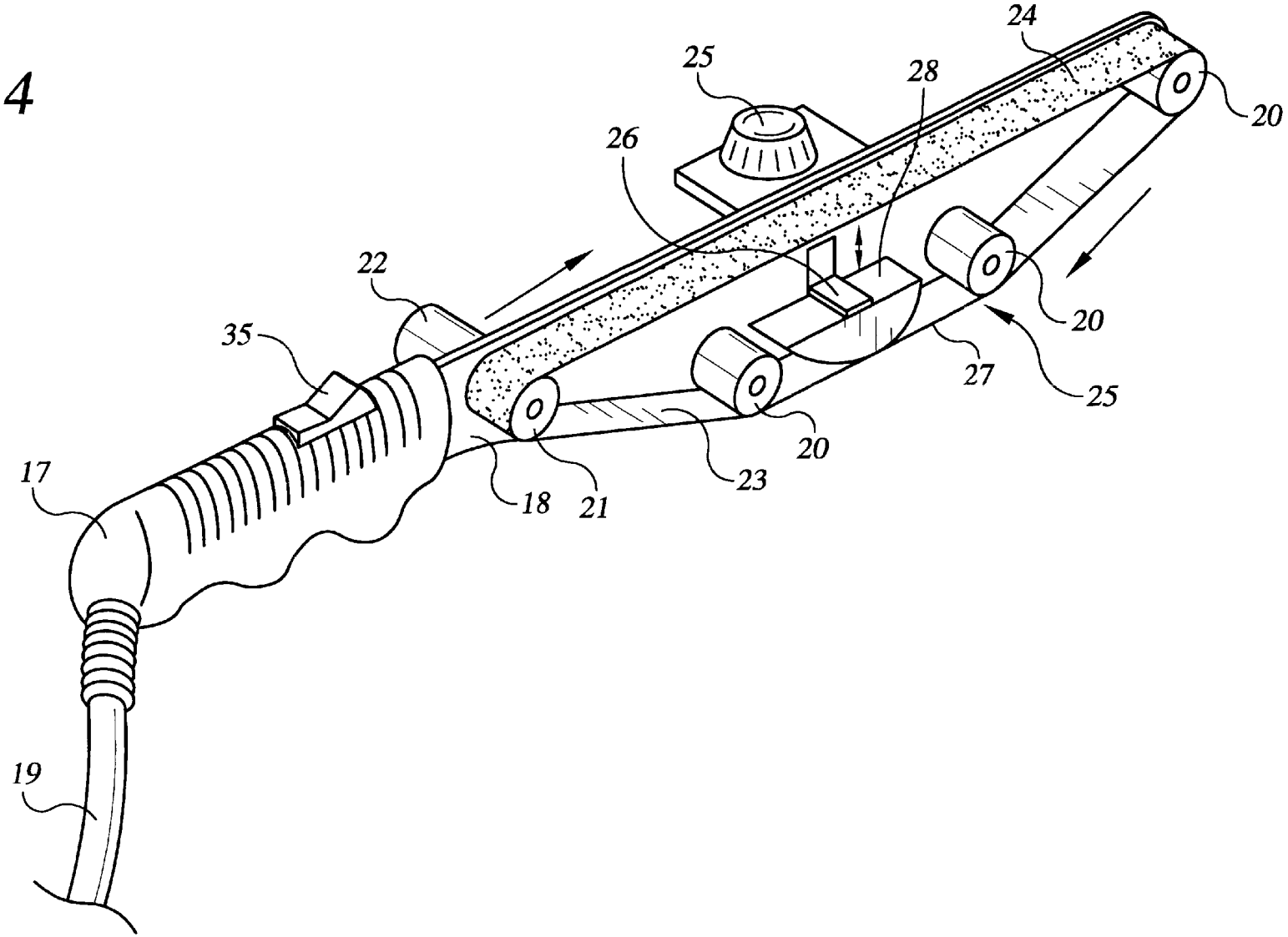
FIG. 4 depicts a second embodiment according to the present invention.
Figure 5:
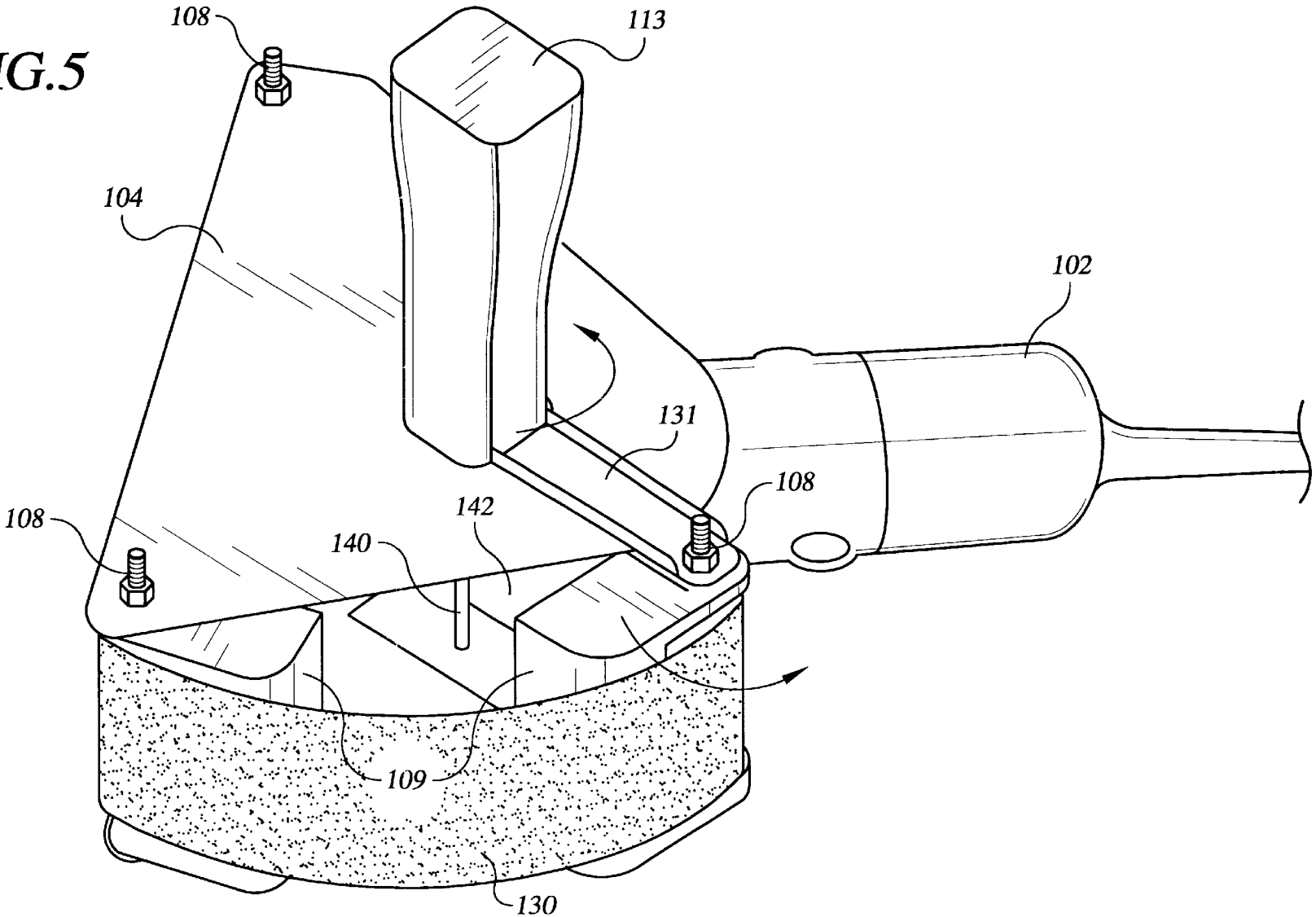
FIG. 5 depicts a third embodiment according to the present invention.
Figure 6:
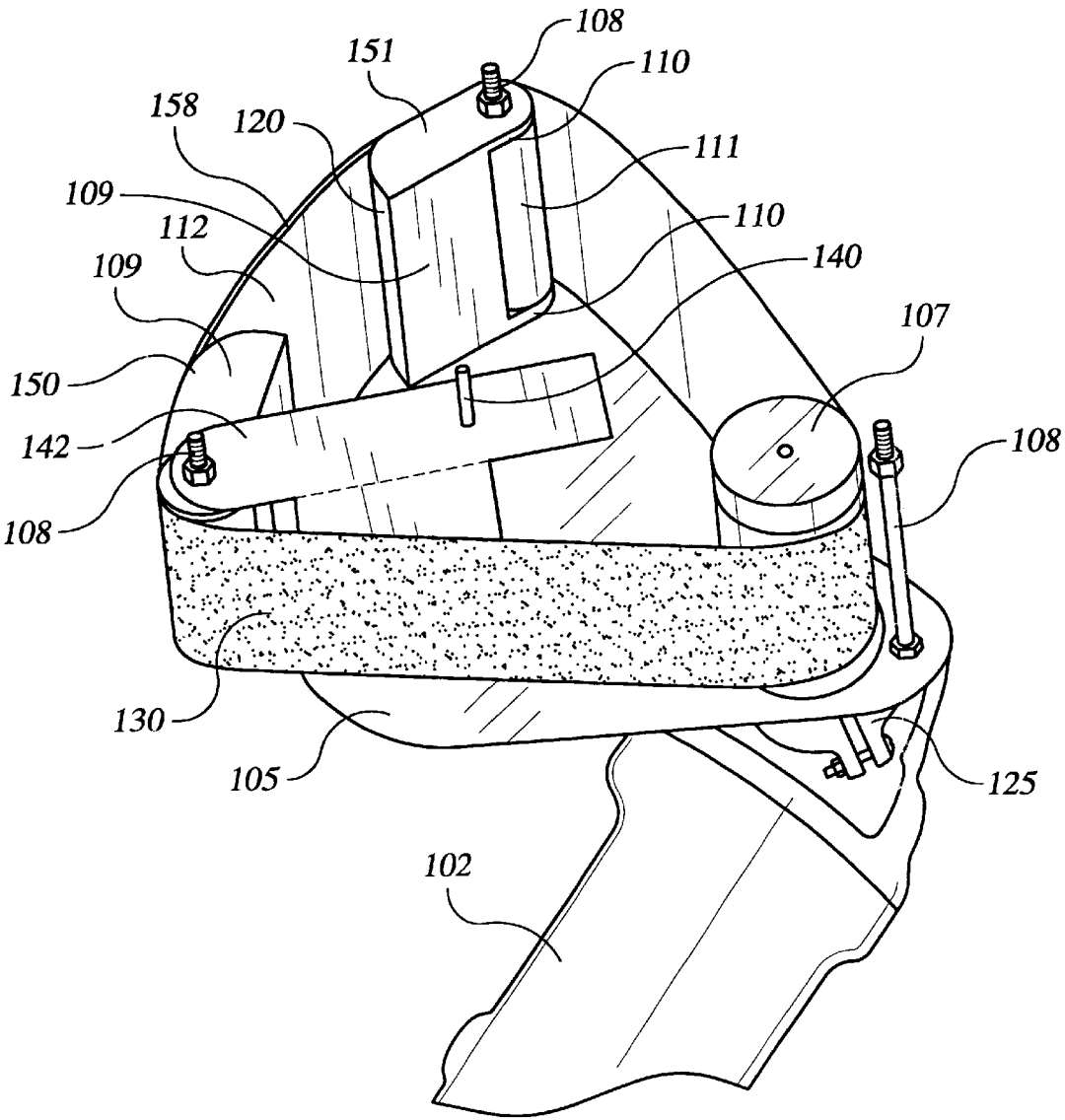
FIG. 6 is a top view of the third embodiment with the upper panel removed.
Figure 7:
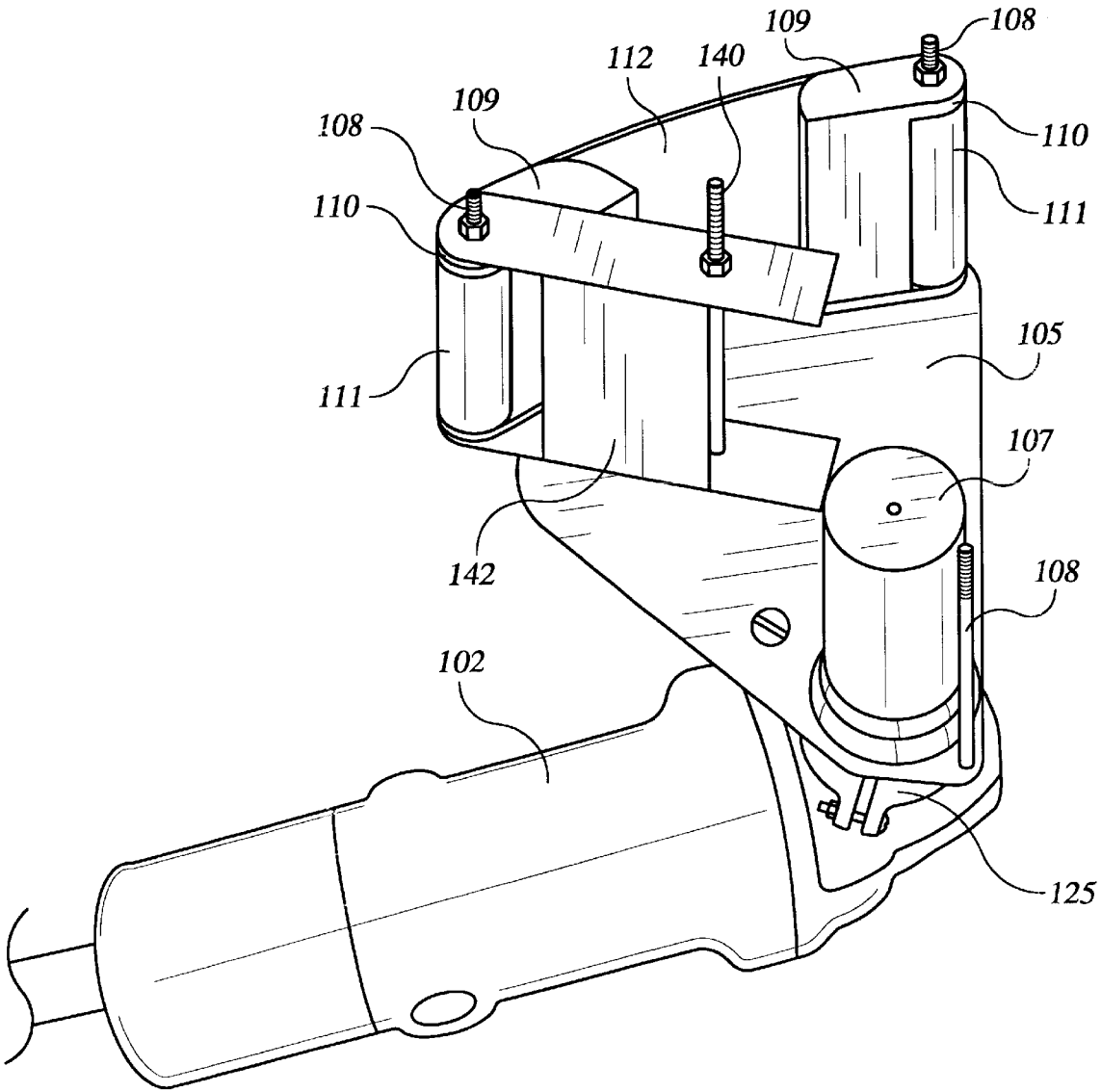
FIG. 7 is a view similar to that depicted in FIG. 6 with the sanding belt also removed.

A second embodiment of the present invention is depicted in FIG. 4 and relates to a hand held sander. The device comprises a handle member 17 having two opposing ends with an elongated, flat blade 18 extending from a first end thereof. A cord 19 extends from the opposing end which may be coupled with an electrical source to power a motor via a switch means 35. The blade has two opposing planar surfaces on a first of which are a plurality of idler rollers 20 and a drive roller 21. The motor 22 is disposed on an opposing side of the blade and is in mechanical communication with the drive roller.

A continuous sanding belt 23 encompasses the idler and drive rollers and is moved along an endless path that includes a substantially flat upper section 24 and a downwardly sagging lower section 25. The space between a pair of idler rollers at the sagging section defines a sanding portion 27. Within the boundary of the belt proximal the sanding portion is an engagement member 28 having a semicircular lower edge and a flat upper edge similar to that described above. The engagement member is vertically movable along the blade with an adjustment means to vary the curvature of the sanding surface similar to that described above. On the flat upper edge of the engagement member is a plate 26 that moves the semi-circular lower edge towards or away from the belt when a knob 25 is rotated. The knob 25 and plate 26 mechanism are conventional and are therefore not described nor depicted in detail.

Now referring to FIGS. 5–8, a third embodiment is depicted for use with a conventional hand held grinder. Such a grinder typically includes a chassis 102 with a handle attached thereto. At an end of the chassis is a neck extending from which is an externally threaded, motor driven shaft to which grinding disks are attached. The sander according to the third embodiment is designed for use with a conventional sander as described above.

The sander includes upper 104 and lower 105 substantially triangular spaced panels. Disposed between the upper and lower panels and rotatably attached thereto is a driver roller 107. The lower end of the drive roller protrudes through an aperture 190 on the lower panel. The drive roller includes an internally threaded bore for receiving the threaded, motor-driven shaft on the grinder. The upper and lower panels are secured in a spaced relationship with a plurality of elongated bolts 108.

Likewise disposed between the upper and lower panels are a pair of block members 109 each having upper and lower flanges 110 extending from a first end thereof. Disposed between each pair of flanges is an idler roller 111. One of the block members 151 is fixed and includes a pin extending through both flanges and the interposed idler roller to secure the block member and the idler roller to the upper and lower panels. The second end 120 of the fixed block member is free and pivotal relative to the upper and lower panels.

The other block member 150 is movable relative to the upper and lower panels. An H-bracket 142 is fastened at one end to the upper and lower panels using an elongated bolt. The movable idler roller and corresponding block member are attached to the other end of the H-bracket using a pin 140. A handle 113 is positioned on the upper surface of the upper panel and is attached to the pin 140. An arm interconnects the handle to the upper end of the H-bracket.

The sander also includes a flexible, bendable plate 112 having two opposing ends. Each end is attached to the free end of one of the block members. As with the other embodiments, a continuous sanding belt 130 circumscribes the idler rollers and drive roller and includes a sanding portion 158 immediately adjacent the plate. Accordingly, as the handle is rotated in either direction, the H-bracket and thus the movable block member pivot whereby the degree of curvature of the flexible plate, and the sanding portion of the belt, is varied.

Figure 8:
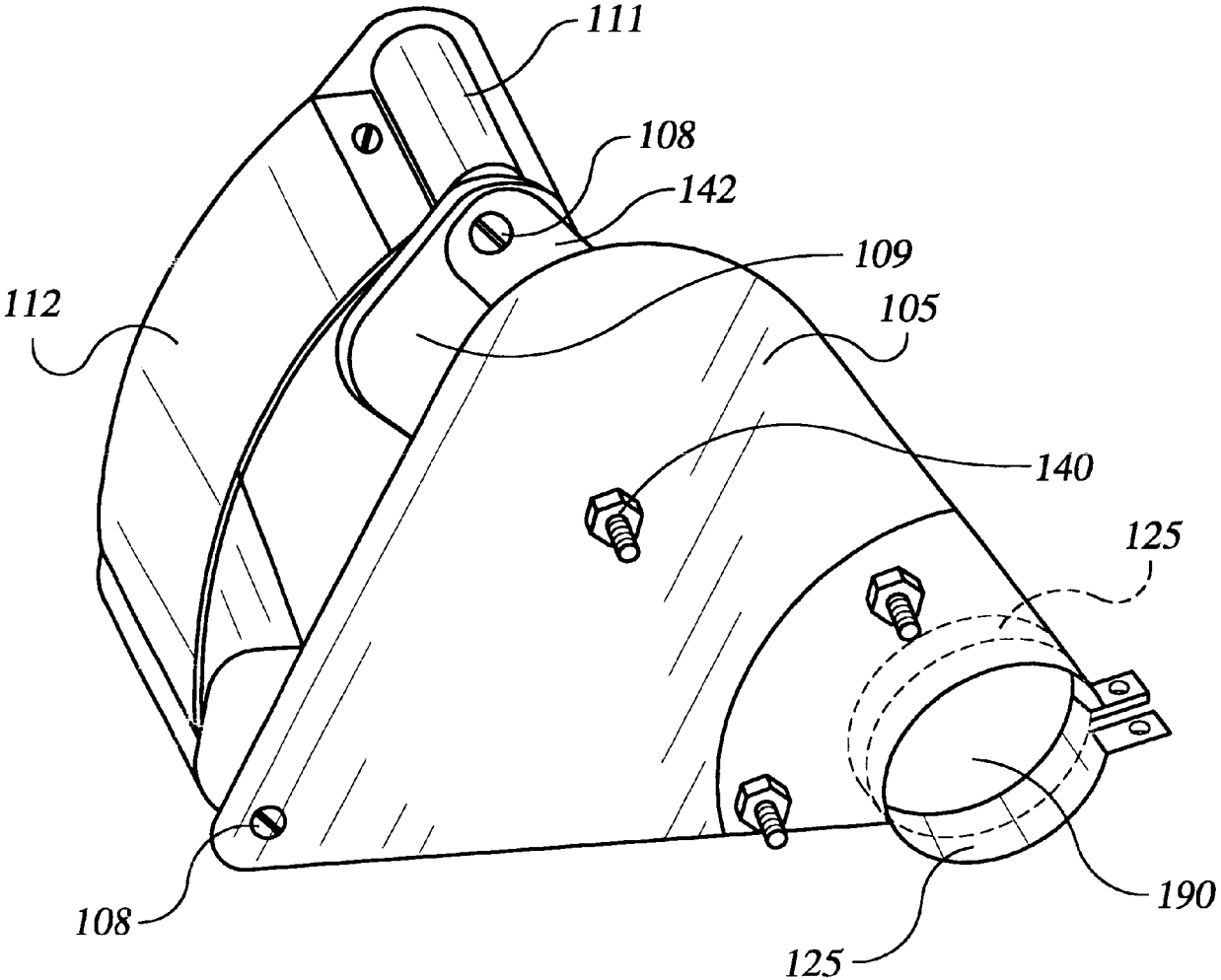
FIG. 8 is a bottom view of the lower panel.

Now referring to FIG. 8, preferably a collar 125 is fastened to the lower surface of the lower plate. The circumference of the collar is adjustable with a screw and nut. The collar is tightened about the grinder neck to prevent the sander from shifting or rotating whenever the grinder is operating and the sander is attached thereto. The collar is preferably concentric with the aperture 190 on the lower plate.

The bendable plate may be made from steel or a similar material while the rollers, engagement member and support surface may be made from wood. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A sander for smoothing curvilinear surfaces comprising:

a horizontal support surface having top and bottom sides;

a drive roller and a plurality of idler rollers disposed on the top side of said support surface;

a continuous sanding belt encompassing said drive and idler rollers;

a motor means for moving said belt along an endless path, a section of said path forming a sanding portion;

a flexible, bendable plate having an inner and outer side, said plate disposed within the boundary of said belt with its outer side immediately adjacent said sanding portion;

a movable engagement member having a semicircular outer edge and an inner edge, the semicircular edge immediately adjacent the inner side of said plate, said engagement member movable in either of two directions to bend said plate back onto itself until said sanding portion is at a desired curvature.

2. The device according to claim 1 further comprising means for maintaining tension on said belt regardless of the curvature of said sanding portion.

3. The device according to claim 1 further comprising:

a fixed-block immediately adjacent the inner edge of said engagement member having a bolt means translatable therethrough, an end of which abuts the inner edge of said engagement member to move said engagement member towards said plate.

4. A device according to claim 2 wherein said belt tensioning means comprises:

said support surface further including two opposing inner and outer slots;

a pair of spring biased plates pivotally secured to the lower side of said support surface, each of said plates disposed immediately below an inner and outer slot;

each of said idler rollers secured to a discrete plate with a fastener means extending from said idler roller through an inner slot to said plate;

said plate having a pair of anchoring posts on opposing edges thereof each received within an outer slot and secured to a pivoting plate therebelow to allow said plates, said idler rollers and said anchoring posts to synchronously pivot thereby maintaining tension on said belt as said sanding portion is bent.

5. The device according to claim 1 wherein said idler and drive rollers are disposed in a substantially triangular orientation.

6. A sander for smoothing curvilinear surfaces comprising:

an upper panel;

a lower panel spaced from said upper panel;

a drive roller disposed between said upper and lower panels;

a first block member pivotally secured to said upper and lower panels;

a first idler roller attached to said first block member;

a bracket pivotally secured to said upper and lower panels;

a second block member secured to said bracket and movable relative to said upper and lower panels;

a second idler roller attached to said second block member;

a bendable plate having two opposing ends, each of said ends attached to one of said block members;

a continuous sanding belt encompassing said drive roller, said idler rollers and said plate, said belt having a sanding portion immediately adjacent said plate;

a handle secured to said bracket whereby rotation of said handle causes said bracket, said second block member and said second idler roller to pivot thereby varying the degree of curvature of said plate and said sanding portion.

7. A sander for smoothing curvilinear surfaces according to claim 6 wherein said drive roller includes an internally threaded bore for threadedly coupling said drive roller to a threaded shaft on a power tool.

8. A sander for smoothing curvilinear surfaces according to claim 6 wherein said lower plate includes a lower surface having an adjustable collar attached thereto for securing said sander to a power tool chassis.

* * * * *